United States Patent [19]

Magara et al.

[11] Patent Number: 4,969,650

[45] Date of Patent: Nov. 13, 1990

[54] GAME MACHINE WITH AUTOMATIC JUDGING FUNCTION

[75] Inventors: Yutaka Magara, Ichikawa; Takashi Ishii, Matsudo; Shigenobu Hagimori, Ichikawa, all of Japan

[73] Assignee: Fuji Electronic Industry, Co., Ltd., Chiba, Japan

[21] Appl. No.: 378,821

[22] Filed: Jul. 12, 1989

[30] Foreign Application Priority Data

Mar. 31, 1989 [JP] Japan ..... 1-83018

[51] Int. Cl.[5] ..... A63F 3/00

[52] U.S. Cl. ..... 273/238; 273/237

[58] Field of Search ..... 273/237, 238

[56] References Cited

U.S. PATENT DOCUMENTS

| | | | |
|---|---|---|---|
| 3,481,604 | 12/1969 | Fan | 273/238 |
| 3,697,076 | 10/1972 | Vogel | 273/238 |
| 3,797,830 | 3/1974 | Breslow | 273/238 |
| 4,327,920 | 5/1982 | Becker et al. | 273/238 |
| 4,343,609 | 8/1982 | Cardinal | 273/238 |
| 4,372,558 | 2/1983 | Shimamoto et al. | 273/238 |

*Primary Examiner*—Edward M. Coven
*Assistant Examiner*—Dean Small
*Attorney, Agent, or Firm*—Venable, Baetjer and Howard

[57] ABSTRACT

A game machine with an automatic judging function according to the present invention is used to play a game in which a winner is determined according to predetermined rules of the game by moving pieces having their own characters across a game board, e.g., a checkerboard. The game machine includes classified pieces whose characters cannot be known by an opponent, a checkerboard with sensors for detecting the rank characters of the pieces disposed thereon, and a judging unit for automatically determining the winning piece on the basis of the rank characters of the pieces when they encounter on the game board. Accordingly, a game player can enjoy a game by inferring the rank characters and future moves of opponent's pieces.

14 Claims, 6 Drawing Sheets

GAME MACHINE WITH AUTOMATIC JUDGING FUNCTION

BACKGROUND OF THE INVENTION

1. Field of the Invention

The present invention relates to a game machine with automatic judging function for playing a game which involves by moving pieces across areas provided on a game board.

2. Description of the Related Art

Chess is an example of a game which is played by alternately moving a plurality of pieces across a game board.

Chess basically employs several types of pieces, as well as a checkerboard across which these pieces are moved.

Chess is a game for two players who take turns to move pieces on the checkerboard.

A checkerboard is a check pattern board with 8 files×8 ranks, i.e., sixty-four black and white squares, each of which is located next to squares of different color.

Each of the pieces used in chess is either of dark or light color. Each of the players begin a game with 16 pieces disposed on their own starting squares. These 16 pieces are classified into 6 types and consist of one King, one Queen, two Rooks, two Bishops, two Knights, and eight Pawns.

The game progresses by one of the players moving one piece from a pre-occupied square to another or by a player advancing his piece to the square occupied by an opponent's piece and at the same time removing the opponent's piece located at that square.

Each type of piece can be moved in a particular way which is ruled by the character of piece concerned, such as King or Queen. For example, a King can move in any direction by one square and can remove the opponent's piece if located in that square. A rook can move up and down and to the right and left over any desired number of squares and remove the opponent's piece if located on the route of its movement.

The game is won by the player who attacks the opponent's King and corners it in a position from which escape is impossible, which is called "checkmate". The game is finished when one of the players checkmates the opponent's King.

Chess is an internationally popular games.

Games which are similar to chess include Japanese "shogi" game.

Shogi resembles chess very closely with a few differences in the rules, such as the number of pieces and the movement of the pieces.

However, in both of these games, the checkerboard is only used to locate the pieces.

Further, the pieces employed in chess or shogi have their own shape or symbols which represent the category to which they belong, so that each player can recognize the piece character, e.g., movement, of every piece on the board.

SUMMARY OF THE INVENTION

An object of the present invention is to provide a game machine which is capable of automatically comparing the rank of pieces by a judging unit when a player puts an opponent's piece whose character is not known to him in check with his piece whose character is known only to him so as to enable the players to infer the character of the opponent's piece from the results of the judgement.

To achieve the above-described object, the present invention provides a game machine with automatic judging function for playing a game which involves by moving pieces across areas provided on a game board, comprising:

a piece set consisting of a plurality of pieces which are divided into groups, said pieces having their own rank characters determined according to the rules of a game but not recognized by opponents;

a game board defined into a plurality of areas;

sensor units for detecting the rank character of said piece located on said area;

a judging unit for judging the encountered pieces by comparing the rank characters thereof detected by said sensor units; and an information unit for informing the judgement resulted from said judging unit.

Using the game machine with the automatic judging function according to the present invention, a game is played by moving pieces whose characters are kept secret to an opponent across a game board. When two pieces of friend and foe encounter on the same area of the game board, the characters of these pieces are detected by the sensors, and the detection signals of the sensors are discriminated by the discrimination circuit such as an electronic circuit. The resultant data are automatically compared in accordance with the rules of the game.

In consequence, the players can enjoy the game by inferring the characters of the opponent's pieces as well as the course of a game from the results of the judgement obtained each time the pieces encounter on the game board.

The game played with the game machine according to the present invention can be thus very exciting.

Embodiments of the present invention will be described hereinafter with reference to the accompanying drawings and tables. The tables are attached to the end of this description of the preferred embodiments.

DESCRIPTION OF THE PREFERRED EMBODIMENTS.

(First Embodiment)

Figure 1:
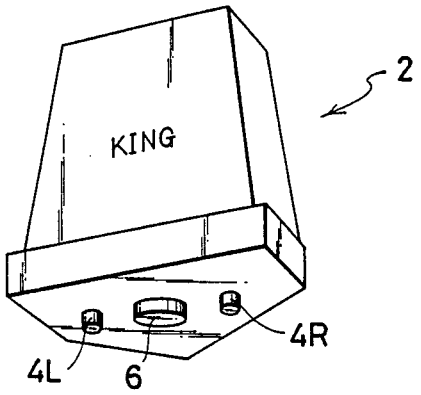
FIG. 1 is a perspective view of a piece employed in a embodiment of the present invention.
Figure 2:
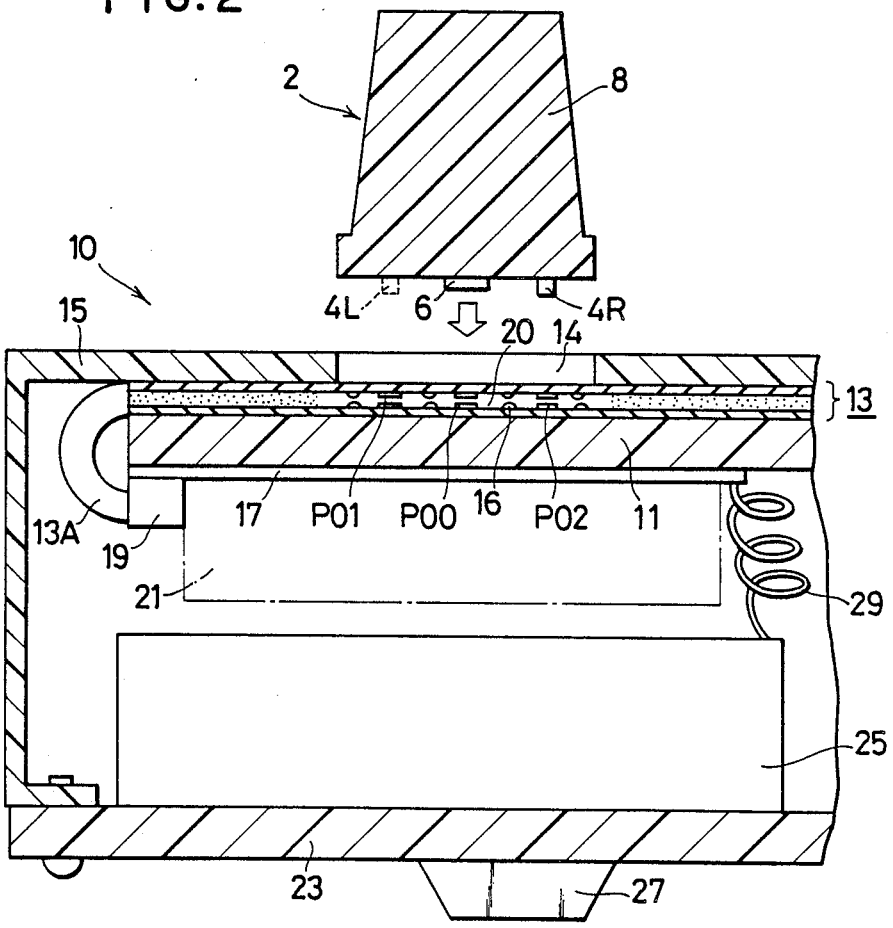
FIG. 2 is a cross-sectional view of the main parts of a checkerboard employed in the embodiment of the present invention, showing the relationship between a piece and a space.

Referring to FIGS. 1 and 2, a piece 2 has a front side and a back side. The piece 2 has also one or two rank bits 4 on the bottom thereof. The individual rank character of pieces 2 is discriminated by the positions and/or the number of rank bits 4.

More specifically, the pieces are divided into the four categories of rank character shown in Table 1: piece (A) having neither left nor right bit, piece (B) having only a left bit 4L as viewed from a back side, piece (C) having only a right bit 4R, and piece (D) having both bits 4L and 4R.

Two rank bits 4L and 4R are used for the classification shown in Table 1. However, the use of three, four and five rank bits allow for classifications into eight, sixteen and thirty-two different categories, respectively.

The bottom of the piece 2 is also provided with a position bit 6.

The position bit 6 has a smaller height than the rank bits 4 so as to enable a sensor unit to detect the rank bits 4L and/or 4R without misalignment. That is, detection of all the rank bits 4 can be confirmed by the detection of the position bit 6 having a smaller height. Use of the position bit also serves to specify the location of the piece concerned.

A certain name, such as "King", representing individual rank character of a piece 2 is so indicated on the back side of a main body 8 of the piece 2, such that the rank character name thereon cannot be seen by an opponent player.

All the pieces belonging to one player in the game have the same color and configuration except for the bottom bit arrangement and back side naming. It is therefore impossible for the any side of game player to know the characters of the opponent's pieces from their external appearance. Preferably, the pieces 2 are made of synthetic resin.

Figure 3:
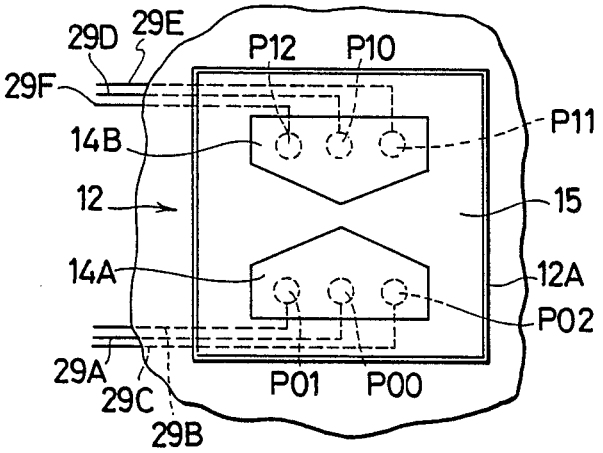
FIG. 3 is a plan view of an area.

In a embodiment which is shown in FIGS. 2 and 3, a checkerboard is employed as a game board.

Next, the essential parts of a checkerboard will be explained with reference to FIGS. 2 and 3.

FIG. 2 is a cross-sectional view of one end portion of a checkerboard 10, showing the relationship between the piece 2 and the checkerboard 10.

As shown in FIG. 2, the checkerboard 10 is laminated board formed by laminating an electric insulating sheet 13 having a thickness of several microcentimeters (the thickness being enlarged for ease of illustration in FIG. 2) onto the top of an intermediate plate 11 made of a synthetic resin with a cover 15 made of a synthetic resin being coated onto the electric insulating sheet 13. The cover 15 has recessed spaces 14 into which the pieces 2 are fitted to occupy.

The sheet 13 has a two-layer structure in which two insulating thin films are bonded to each other with sensor unit 20 connected to a circuit pattern (not shown) interposed therebetween. The sensor unit 20 has spacers 16 for controlling the "On/Off" of the sensors formed therein.

A printed circuit board 17 is mounted on the rear surface of the intermediate plate 11. The printed circuit board 17 has a connector 19, which is connected to a wiring harness 13A formed by collecting conductive circuits of the sheet 13. The printed circuit board 17 has an electronic parts mounting space 21 in which electronic parts such as ICs, capacitors and resistors are mounted.

A battery box 25 connected to the printed circuit board 17 through a lead line 29 is mounted on a bottom plate 23. The bottom plate 23 is screwed on the cover 15. Legs 27 made of rubber are mounted on the bottom surface of the bottom plate 23.

FIG. 3 shows one of the areas provided on the top surface of the checkerboard 10. In an area 12, two spaces 14A and 14B are provided in opposed relation so that the both sides of players can set to encounter their pieces in the same area. In this embodiment, each of the spaces 14A and 14B has its own sensor unit 20. More specifically, the space 14A has sensors P00, P01 and P02 at positions corresponding to the bits, 6, 4L and 4R, and the space 14B has also sensors P10, P11 and P12. Lead lines 29A, 29B, 29C; 29D, 29E and 29F drawn from the sensors P00, P01, P02; P10, P11 and P12 are collected into the wiring harness 13A shown in FIG. 2.

The cover 15 has boundary lines 12A defining the areas 12 on the game board.

The sensor unit 20 for the space 14A in each of the areas includes the spacers 16 for controlling the on/off of the sensors which is achieved by a player to use finger pressure, as well as the sensors P00, P01 and P02 which are made from a conductive switch, as shown in FIG. 2. The opposite space 14B in each area has the same construction.

For example, when a player locates a piece having the bit 4R and the confirmation bit 6, which is referred to as piece (C), in the space 14A and then applies a slight amount of finger pressure to that piece (C), the sensor P01 turns on while the sensor P02 remains off. Some more application of the finger pressure turns on the sensor P00, from which the characteristic data of the piece are sent to a circuit.

In the foregoing embodiment, the piece 2 has bits, and conductive switches are incorporated in the sensor unit. However, magnets may be used in place of the bits. In this case, the sensor portion should be of the type which detects the magnetism of the magnet. Alternatively, the characteristic data of each piece may be detected by the use of an optical sensor.

Figure 4:
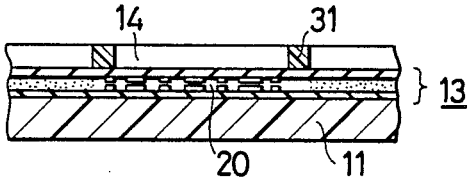
FIGS. 4 and 5 are cross-sectional views, showing modified examples of a space.
Figure 5:
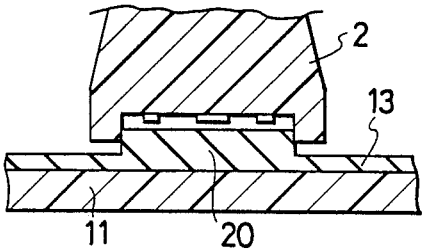

In the embodiment shown in FIG. 2, the spaces 14 are formed as the recessed portions into which the pieces 2 are set. Alternatively, the spaces may be formed as flat or projecting form, like the modified embodiments shown in FIGS. 4 and 5. In the case of the flat space shown in FIG. 4 each space 14 is defined by edges 31 formed on the periphery thereof.

Figure 6:
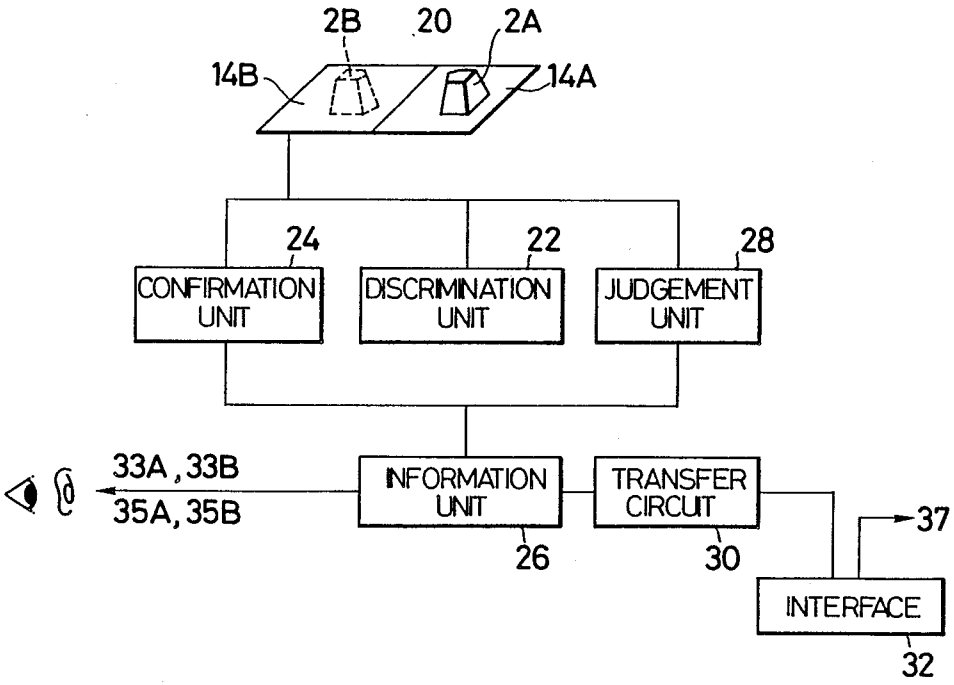
FIG. 6 is a block diagram of a circuit employed in the embodiments of the present invention.

Next, the flow of an electronic signal from the sensor unit 20 will be described with reference to FIG. 6, which is a block diagram of an electronic circuit.

When a player locates a piece 2A in a space 14A and then pushes it until the sensor P00 turns on by means of the position bit 6, the characteristic signals of the piece 2A which are detected by means of the bits 4 as well as the position signal from the sensor P00 which identifies the position of the space 14A are input to and stored in a discriminating unit 22.

At the same time, the position signal from the sensor P00 is input to a confirmation unit 24, and is then transmitted through a information unit 26 to the players by means of audio 33B and/or visual display 33A.

Next, another player moves a piece 2B to the space 14B of the same area 12 and then pushes it until the position sensor P10 turns on. This allows the data on the piece 2B to be sent to the discrimination unit 22. Since the data on the piece 2A located in the space 14A has been stored in the unit 22, two different data are input to a judgement unit 28 and are compared with each other to determine which piece, 2A or 2B, is higher in rank. The results of the judgement are transmitted to the players through the information unit 26 by means of audio 35B and/or visual display 35A.

The defeated piece, or both of the pieces when they are of a equal rank, are removed from the board according to the rules of the game, and the game proceeds.

When a player moves a piece, he turns on the position sensor of the area occupied by the piece before movement, then advances the piece, and subsequently turns on the position sensor of the area to which the piece has arrived to identify the area to which the piece is advanced as well as the piece moved.

In this embodiment, a transfer circuit 30 may be connected to the information unit 26 s that the characteristic data can be transferred to an external computer 37 through an interface 32. In this way, the game or a simulation of the game can be played through an external computer 37, enabling the game to be played with the computer 37 or with a remote opponent over a telephone line.

Figure 7:
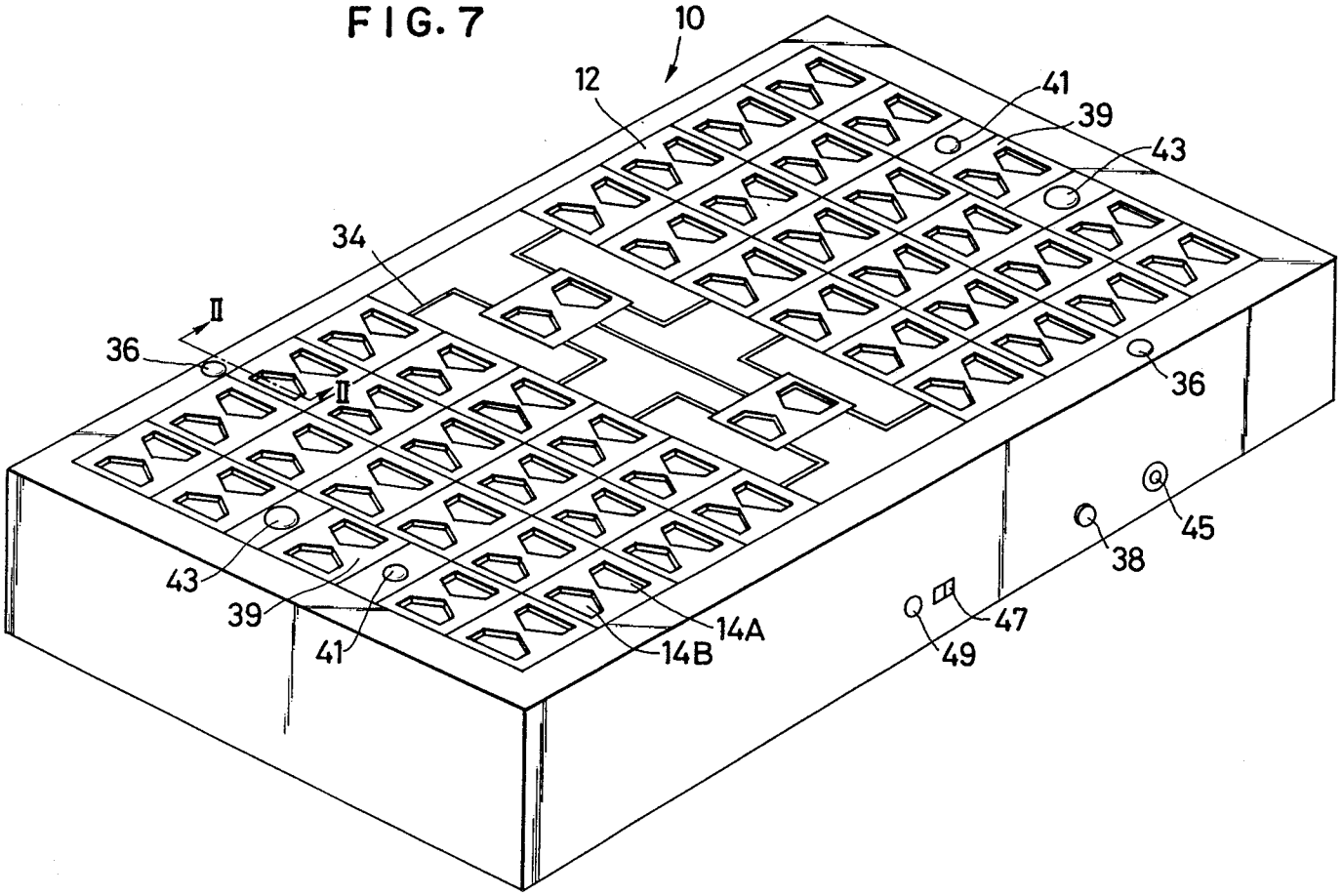
FIG. 7 is a perspective view of a checkerboard employed in the embodiment.

FIG. 7 shows another example of the checkerboard 10.

The surface of the checkerboard 10 shown in FIG. 7 is divided into two regions and an intermediate area. Each of the regions is divided into twenty-four areas, that is, forty-eight areas 12 are defined on the surface of the checkerboard 10 shown in FIG. 7.

Each of the areas 12 has the spaces 14A and 14B so that the both players can set their pieces in the same area. In this case, each of the spaces has its own sensor unit 20.

The intermediate area has routes 34 on which the pieces can be moved. Each of the regions has a goal 39. The game is over when a predetermined type of piece reaches the opponent's goal 39.

The checkerboard shown in FIG. 7 is also provided with confirmation lamps 36 which display the turning on of the position sensors, lamps 41 used to determine which piece is higher in rank, lamps 43 for displaying the winner of the game, a transfer terminal 38 used when the game is played through an external computer, an adapter 45 used when the checkerboard is connected to an external power source, a power switch 47, a power lamp 49 and so on. Alternatively, a battery can be used as the power source.

FIG. 2 shows a sectional view taken along the line II—II of FIG. 7.

The above-described pieces, the layout of the checkerboard, the shape of the areas, the rules of the game and the progress of the game are only examples, and various modifications are possible.

(Second Embodiment)

Figure 8:
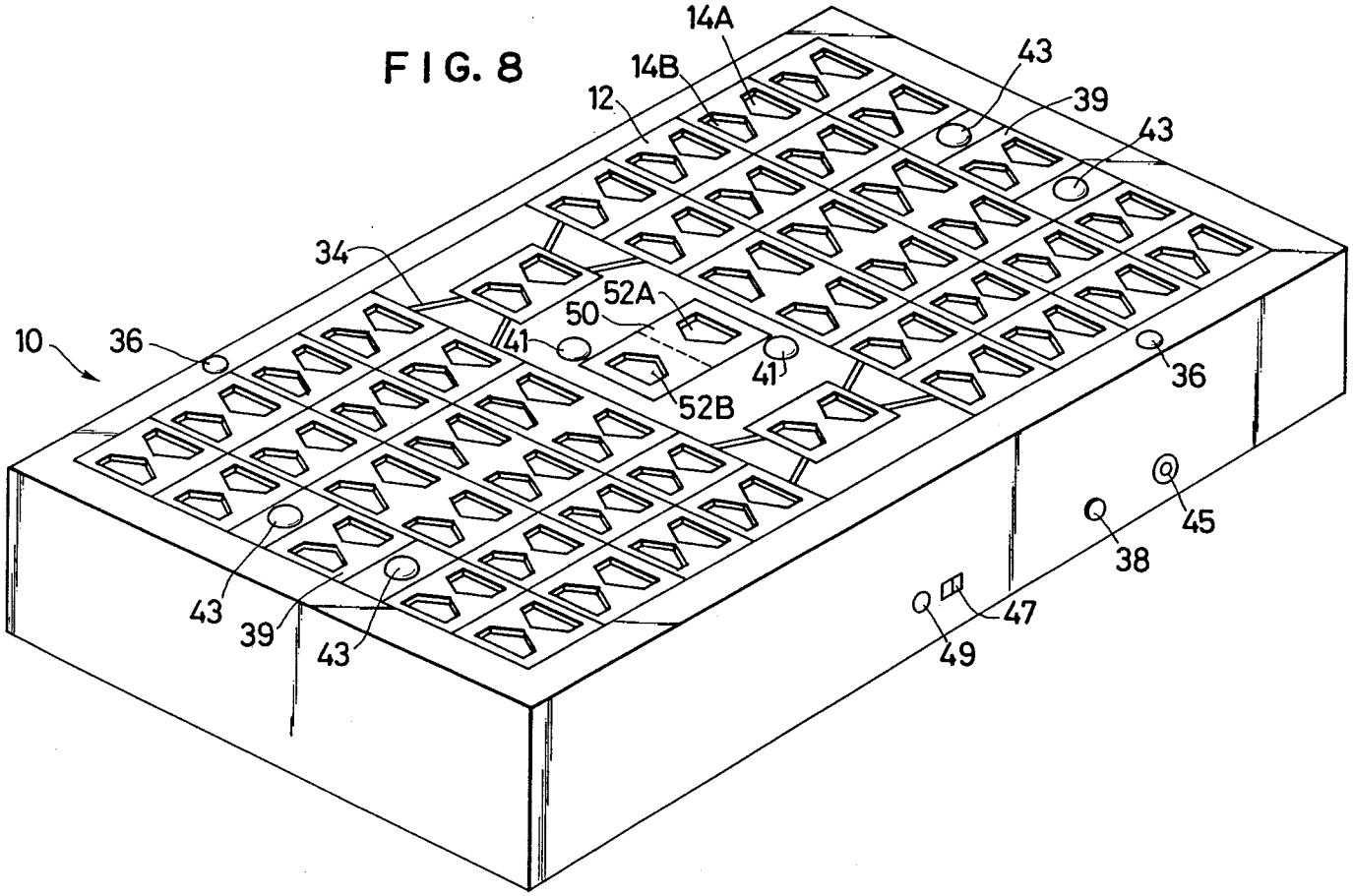
FIG. 8 is a perspective view of a checkerboard employed in another embodiment.

FIG. 8 shows a second embodiment which is a simplified form of the first embodiment.

In this embodiment, each of the areas 12 on the checkerboard 10 has the spaces 14A and 14B, but no sensor unit is provided in any of the spaces 14A and 14B. Sensor unit are provided only in a neutral zone 50.

In this embodiment, when the two pieces of both sides encounter in one area 12, the players put these pieces in corresponding spaces 52A and 52B in the neutral zone 50 to judge which piece is higher in rank.

The sensor unit may be preferably provided not only in the neutral zone 50 but also in the goals 39.

This embodiment has a simple structure and is therefore inexpensive.

(Third Embodiment)

Figure 9:
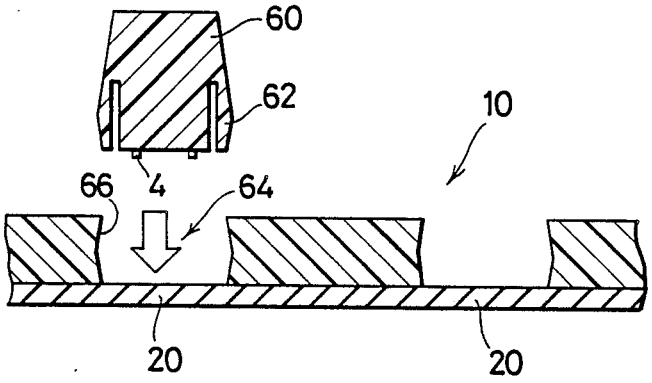
FIG. 9 is a cross-sectional view, showing the relationship between a piece and a space in the other embodiment of the present invention.

Referring now to FIG. 9, the other embodiment according to the present invention is shown thereon.

In this embodiment, the characteristic data on a piece is all input to the discriminating unit by the setting of that piece on the checkerboard.

More specifically, a piece 60 has a click member 62, and a space 64 has an accepting recess 66 into which the piece 60 is inserted, as shown by an arrow in FIG. 9. The engagement of the click member 62 with the accepting recess 66 causes the sensor unit 20 to be pressed by the rank bits 4 provided on the bottom surface of the piece 60, and the sensor unit 20 is kept pressed while the piece 60 is set in the space 64.

This embodiment therefore requires no position bit 6. Data on a piece can be input only by the movement of the piece, and the game can progress smoothly.

(Application)

An example of a game that may be played in the above-described embodiments will be described hereinafter.

Each of the players starts with 23 pieces. These pieces are classified into 14 types of rank character from (A) to (P) as shown in Table 2. In each rank character, the number of pieces possessed by one player is the same as that possessed by the opponent player. Use of a piece with 4 rank bits enables the pieces to be classified into 16 categories at a maximum. AS shown in Table 2, the pieces which belong to each of the categories (A) to (P) have a rank character of that category. In Table 2, "o" represents a higher rank and "x" indicates a lower rank.

Each of the players sets his pieces in the spaces of his own region on the checkerboard in such a manner that the rank characters of the pieces cannot be known by his opponent. The pieces may be moved up and down and to the right and left over one space in one example of the rules.

While playing a game, a player presses a piece down until the confirmation lamp lights up to store the data on the piece, then he moves the piece to a space of the area to which he wants to advance, and presses the piece down again until the confirmation lamp lights up. These operations are not required in the second and third embodiments.

When two pieces of both sides encounter in a certain area the sensor unit thereof output characteristic signals of the pieces located in that area, and the output signals are input to the discriminating unit to discriminate the rank characters of the pieces in check. The data on the pieces are compared by the judging unit according to the rank list shown in Table 2, and the results of the judgement are indicated to both players by means of sound or light.

A defeated piece is removed from the checkerboard by the player to which that piece belongs in such a manner that the rank character thereof is kept secret to the opponent. If the ranks of encountered pieces are even, both of them are removed by their owners.

The players take turns during the game while inferring the rank characters of the opponent's pieces. The game is won by a player who locates a predetermined type of piece at an opponent's goal first.

According to other modified rules, a game may also end when all of the pieces that belong to one player are removed from the checkerboard or when a special piece is defeated.

The above-described applications are illustrated by way of example, and very interesting games utilizing a game machine according to the present invention may be created by changing the number of pieces, the rank characters, the advancing ability of the pieces, the rules of deciding the winner of a game, or naming the such as King, Queen, Pawn . . . ; Shogun, Samurai, Ninja . . . : Zeus, Poseidon, Bacchus . . . ; etc.

The game explained hereinbefore is played by two players. However, it may be enjoyed by three or more players, if the regions, the areas and spaces are modified accordingly.

As will be understood from the foregoing description, in the present invention, the characters of the pieces that belong to both players can be compared and judged in a state where the character of the pieces cannot be known by an opponent. In consequence, the players can infer the characters of the opponent's pieces and the course of a game by locating the pieces whose characters are unknown to the opponent in the same area.

Thus a game machine according to the present invention provide a lot of fan for game players.

TABLE 1

| | With or Without bit | | |
|---|---|---|---|
| | Left bit 4L | Right bit 4R | Symbol |
| Piece (A) | No | No | 00 |
| Piece (B) | No | Yes | 01 |
| Piece (C) | Yes | No | 10 |
| Piece (D) | Yes | Yes | 11 |

TABLE 2

| | (A) | (B) | (C) | (D) | (E) | (F) | (G) | (H) | (J) | (K) | (L) | (M) | (N) | (P) |
|---|---|---|---|---|---|---|---|---|---|---|---|---|---|---|
| (A) | / | O | O | O | O | O | O | O | O | O | X | X | O | — |
| (B) | X | / | O | O | O | O | O | O | O | O | O | X | O | — |
| (C) | X | X | / | O | O | O | O | O | O | O | O | X | O | — |
| (D) | X | X | X | / | O | O | X | X | O | O | O | X | X | — |
| (E) | X | X | X | X | / | O | X | X | O | O | O | X | X | — |
| (F) | X | X | X | X | X | / | X | X | O | O | O | X | X | — |
| (G) | X | X | X | O | O | O | / | O | O | O | O | O | X | — |
| (H) | X | X | X | O | O | O | X | / | O | O | O | X | X | — |
| (J) | X | X | X | X | X | X | X | X | / | O | O | X | X | — |
| (K) | X | X | X | X | X | X | X | X | X | / | O | X | X | — |
| (L) | O | X | X | X | X | X | X | X | X | X | / | X | X | — |
| (M) | O | O | O | O | O | O | X | O | O | X | O | / | X | — |
| (N) | X | X | X | O | O | O | O | X | O | O | O | O | / | — |
| (P) | SAME RANK AS THAT THEREBEHIND | | | | | | | | | | | | | |

What is claimed is:

1. A game machine having an automatic judging function for playing a game in which pieces are moved across areas provided on a game board, comprising:

a piece set consisting of a plurality of pieces which are divided into groups, each of said pieces having a selected ranking characteristic in accordance with the rules of a game that is not visibly apparent to opponents:

a game board defined into a plurality of areas;

a sensor unit provided in each of said plurality of game board areas for detecting said ranking characteristic of each of said pieces located on said game board area;

means for judging said pieces by comparing the ranking of said pieces detected by said sensor units; and means for indicating the results of said judging means.

2. A game machine according to claim 1, wherein said ranking characteristic of each of said pieces is defined by a plurality of rank bits mounted along the bottom side of said pieces, said rank bits being detectable by said area sensor unit so as to permit classification of said pieces in accordance with the presence and absence of said rank bits.

3. A game machine according to claim 2, wherein each of said pieces has a position bit mounted along the bottom surface thereof that is detectable by said sensor unit to determine the position of each of said pieces on said game board.

4. A game machine according to claim 1, wherein each of said pieces in the same group is provided with substantially the same appearance and is arranged on the game board such that at least one side of each piece is not visible to an opponent.

5. A game machine according to claim 1, wherein said piece set is divided into two groups for use respectively by two opposing players, and wherein said judging means is operable to determine the winning piece between two pieces which have been placed on a selected one of said game board areas.

6. A game machine according to claim 1, wherein each of said areas is provided with a plurality of recesses in which said pieces can be set, said sensor units being disposed in said recesses.

7. A game machine according to claim 6, wherein each of said recesses is provided with an engaging portion into which said piece is fitted, said engaging portion being constructed such that said sensor unit is pressed by said rank bits when said piece is fitted into said engaging portion.

8. A game machine according to claim 1, wherein the upper surface portion of said game board is formed by laminating an insulative sheet with said sensor units and a conductive circuit formed therein on top of an intermediate plate, and wherein said sheet is provided with a plurality of recesses into which said pieces can be positioned.

9. A game machine according to claim 1, wherein said sensor units protrude from the upper surface of said game board.

10. A game machine according to claim 1, wherein said judging means includes an electronic judging circuit for comparing said ranking characteristic of said pieces on said game board and for determining the results of a game in accordance with game rules inputted into the judging means.

11. A game machine according to claim 1, wherein each of said sensor units is made from a conductive switch, said conductive switch being turned on by means of bits provided on the bottom surface of each of said pieces when a corresponding one of the bits of one of said pieces engages said sensor unit.

12. A game machine according to claim 3, further comprising means for confirming that said position bit is detected by a corresponding one of said sensor units.

13. A game machine according to claim 1, further comprising telecommunication means for exchanging data with another, opposing game machine during the course of a game.

14. A game machine according to claim 1, further comprising telecommunication means for receiving data from an external source to simulate game play between opposing game machines.

* * * * *